US009657573B2

(12) United States Patent
Higashimori

(10) Patent No.: US 9,657,573 B2
(45) Date of Patent: May 23, 2017

(54) MIXED FLOW TURBINE

(75) Inventor: Hirotaka Higashimori, Nagasaki (JP)
(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 387 days.
(21) Appl. No.: 14/359,140
(22) PCT Filed: Sep. 6, 2012
(86) PCT No.: PCT/JP2012/072817
§ 371 (c)(1),
(2), (4) Date: Jun. 4, 2014
(87) PCT Pub. No.: WO2014/038054
PCT Pub. Date: Mar. 13, 2014
(65) Prior Publication Data
US 2015/0218949 A1 Aug. 6, 2015
(51) Int. Cl.
*F01D 1/02* (2006.01)
*F01D 5/04* (2006.01)
(Continued)
(52) U.S. Cl.
CPC ..... *F01D 5/048* (2013.01); *F01D 1/026* (2013.01); *F01D 5/141* (2013.01); *F01D 9/026* (2013.01);
(Continued)
(58) Field of Classification Search
CPC ..... F01D 1/026; F01D 5/043; F01D 5/048; F01D 5/141; F01D 9/026; F05D 2210/43; F05D 2240/241
See application file for complete search history.

(56) References Cited

U.S. PATENT DOCUMENTS 4,141,672 A 2/1979 Wieland et al.
4,904,158 A 2/1990 Kun
(Continued)

FOREIGN PATENT DOCUMENTS

DE 39 08 285 C1 6/1990
DE 10 2005 019 937 B3 5/2006
(Continued)

OTHER PUBLICATIONS

Machine Translation of DE 3,908,285, Sumser et al, Published Jun. 7, 1990.*
(Continued)

*Primary Examiner* — Craig Kim
*Assistant Examiner* — Jason Davis
(74) *Attorney, Agent, or Firm* — Birch, Stewart, Kolasch & Birch, LLP

(57) ABSTRACT

An object is to provide a mixed flow turbine, wherein intermediate blades having an intermediate height are provided between main blades of the mixed flow turbine, thus improving an impulse blade turbine characteristic and reducing the moment of inertia for a rotor blade as a whole, thereby improving the efficiency and transient response. The mixed flow turbine includes: a turbine rotor blade 11; a turbine housing 3; a scroll partition wall 17 dividing a scroll chamber 13; a shroud-side inflow passageway 35 formed on the side of a shroud-side partition wall surface 25; and a hub-side inflow passageway 29 formed on the side of a hub-side partition wall surface 23, wherein the rotor blade 11 includes: main blades 37 formed with a height spanning the entire extent between a hub outer circumferential surface 31 and the inner periphery surface of a shroud portion 15; and intermediate blades 39 arranged in the circumferential direction between the main blades 37 and arranged so as to extend from the inlet portion of the main blades 37 to an intermediate portion and having an intermediate height with respect to the height of the main blades 37, wherein a fluid from the hub-side inflow passageway 29 flows in through front edges of the intermediate blades 39.

17 Claims, 10 Drawing Sheets

(51) Int. Cl.
*F01D 5/14* (2006.01)
*F01D 9/02* (2006.01)

(52) U.S. Cl.
CPC ..... *F05D 2210/43* (2013.01); *F05D 2220/40* (2013.01); *F05D 2240/241* (2013.01)

(56) References Cited

U.S. PATENT DOCUMENTS

| | | | | |
|---|---|---|---|---|
| 6,672,061 | B2 | 1/2004 | Schmid et al. | |
| 6,834,500 | B2 | 12/2004 | Sumser et al. | |
| 2003/0230085 | A1 | 12/2003 | Sumser et al. | |
| 2004/0105756 | A1 | 6/2004 | Higashimori et al. | |
| 2007/0134086 | A1* | 6/2007 | Higashimori ..... | F04D 29/284 415/208.3 |
| 2007/0180826 | A1 | 8/2007 | Sumser et al. | |
| 2007/0231141 | A1 | 10/2007 | Chaing et al. | |
| 2009/0290980 | A1 | 11/2009 | Higashimori | |

FOREIGN PATENT DOCUMENTS

| | | | |
|---|---|---|---|
| GB | 1 549 373 | A | 8/1979 |
| JP | 63-92001 | U | 6/1988 |
| JP | 8-121184 | A | 5/1996 |
| JP | 2004-92498 | A | 3/2004 |
| JP | 2004-510094 | A | 4/2004 |
| JP | 2008-503685 | A | 2/2008 |
| JP | 2008-132403 | A | 6/2008 |
| JP | 4288051 | B2 | 4/2009 |
| JP | 2009-281197 | A | 12/2009 |
| JP | 2012-102745 | A | 5/2012 |
| WO | WO 2006/117072 | A1 | 11/2006 |

OTHER PUBLICATIONS

Chinese Office Action effective Jan. 15, 2015 issued in corresponding Chinese Application No. 201280053347.1 with an English Translation.

International Preliminary Report on Patentability mailed Mar. 19, 2015 with English Translation.

Decision to Grant a patent dated May 7, 2015 issued in corresponding Japanese Application No. 2014-534117 with an English translation.

Chinese Notice of Allowance and English translation thereof, dated Sep. 1, 2015, for Chinese Application No. 201280053347.1.

Extended European Search Report effective Jun. 24, 2016 issue in the corresponding EP Application No. 12884285.3.

International Search Report, along with an English translation and Written Opinion of the International Searching Authority (Forms PCT/ISA/210, PCT/ISA/237 and PCT/ISA/220), dated Nov. 27, 2012, for International Application No. PCT/JP2012/072817.

* cited by examiner

"CONVENTIONAL ART"

"CONVENTIONAL ART"

MIXED FLOW TURBINE

TECHNICAL FIELD

The present invention relates to a mixed flow turbine for use in a small gas turbine, a supercharger, an expander, and the like.

BACKGROUND ART

With turbochargers required to have transient response, there is a demand for "an improvement in efficiency" for converting the exhaust energy into an increase in the suction pressure, and "an improvement in rotational acceleration" for reducing the "so-called turbo lag", a delay in the power increase of an engine with a turbocharger.

Therefore, the efficiency of the compressor and the turbine has been improved, and the moment of inertia of the rotor has been reduced by reducing the size and weight of the turbine wheel, thereby improving the response of the turbo engine when accelerating.

Generally, in order to "improve the efficiency aerodynamically", it is an effective approach, for example, to increase the number of blades to reduce the blade load, but it will increase the weight and increase the inertial mass, on the other hand, thereby resulting in a problem of a "decrease in the rotational acceleration", and therefore there has been a demand for an approach capable of realizing both of these contradicting effects.

The present applicant has proposed a technique of a mixed flow turbine shown in Patent Document 1 as one that suppresses the turbine efficiency decrease, or one that suppresses the efficiency decrease in a mixed flow turbine in particular.

Referring to FIG. 17, a mixed flow turbine disclosed in Patent Document 1 will be described.

Provided is a mixed flow turbine 201 including: a hub 205 rotating about a central axis K; a plurality of rotor blades 207 provided standing on a hub outer circumferential surface 206 with its front edge 247 protruding toward the upstream side; a casing 213 having a shroud portion 227 covering a radial outer edge 225 of the rotor blade 207; and a scroll 223, which is a space formed on the upstream side of the rotor blade 207 for supplying a fluid toward the front edge 247 of the rotor blade 207, wherein the scroll 223 is divided by a scroll partition wall 229 into a shroud-side space 231 and a hub-side space 233.

Since a shroud-side partition wall surface 237 and a hub-side partition wall surface 235 on the rear edge side of the scroll partition wall 229 are provided with a shroud-side wall surface 243 and a hub-side wall surface 239 formed so as to oppose generally parallel thereto, respectively, there are formed, between respective wall surfaces, a shroud-side inflow passageway 245 where the fluid flows in a generally radial direction and a hub-side inflow passageway 241 where the fluid flows in a direction generally equal to the inclination direction on the hub side of the blade inlet.

Since the fluid supplied through this shroud-side inflow passageway 245 flows in a generally radial direction, the fluid flows in so as to be parallel to the shroud-side wall surface 243 and generally orthogonal to the inlet-side edge of the rotor blade. Therefore, at the shroud-side blade front edge of the mixed flow turbine rotor blade inlet, the flow can be guided into the rotor blade 207 at an appropriate flow angle.

Since the fluid supplied through the hub-side inflow passageway 241 is flowing in a direction generally equal to the inclination direction of the hub outer circumferential surface 206 of the mixed flow turbine rotor blade inlet, the fluid flows in so as to be parallel to the hub outer circumferential surface 206 and generally orthogonal to the blade front edge of the rotor blade. Therefore, at the hub-side blade front edge of the mixed flow turbine rotor blade inlet, the flow can be guided into the rotor blade 207 at an appropriate flow angle.

Since the flow coming from the hub-side inflow passageway 241 into the rotor blade 207 flows into the rotor blade 207 with an angle generally equal to the inclination of the hub outer circumferential surface 206, the flow through the shroud-side inflow passageway 245, which comes from the shroud-side inflow passageway 245 into the rotor blade 207 in a generally radial direction and is turned to the axial direction toward the rotor blade outlet, can be smoothly turned from the radial direction to the axial direction, thereby making it possible to prevent an increase in the wall surface boundary layer occurring in the shroud portion.

On the other hand, the fluid flows in a generally radial direction in the shroud-side inflow passageway 245, whereas the fluid flows in a direction generally equal to the hub-side inclination direction of the mixed flow turbine rotor blade inlet in the hub-side inflow passageway 241, and the fluids having passed through the inflow passageways flow into the inlet-side edge of the mixed flow turbine rotor blade while being orthogonal to each other.

Therefore, the fluids flowing in the shroud-side inflow passageway 245 and the hub-side inflow passageway 241 merge together at the rear edge of the scroll partition wall 229. Thus, it is possible to suppress the development of a wake occurring at the rear edge of the scroll partition wall 229.

Note that the mixed flow turbine having a turbine rotor blade with its front edge protruding toward the upstream side of Patent Document 1 is also disclosed in Patent Document 2.

Patent Document 1: Japanese Patent Application Laid-open No. 2009-281197

Patent Document 2: Japanese Patent No. 4288051

DISCLOSURE OF THE INVENTION

FIG. 18 shows velocity triangles at representative radii for the shroud-side inlet and the hub-side inlet of the rotor blade 207 flowing in from the shroud-side inflow passageway 245 and the hub-side inflow passageway 241.

The flow coming in from the shroud-side inflow passageway 245 flows into the rotor blade 207 at the flow velocity A at a flow angle $\alpha$ of about 20 to 30 degrees. The circumferential velocity C is a velocity that substantially coincides with the circumferential swirl velocity of the rotor blade 207, and the radial velocity, which is the relative flow velocity B, is a velocity representative of the flow rate.

The flow coming in from the shroud-side inflow passageway 245 does work on the rotor blade 207 as the radius varies inside the rotor blade 207, and flows out toward the discharge port while the circumferential velocity lowers and the pressure lowers.

On the other hand, the flow coming in from the hub-side inflow passageway 241 flows into the hub-side inlet at a flow velocity A' greater than the shroud-side inlet since the radius of the hub-side inlet P2 is smaller than the radius of the shroud-side inlet P1, and the flow coming from the shroud-side inlet flows into an area of a small radius and flows into a position where the pressure has decreased.

Since the radius of the hub-side inlet is smaller than the radius of the shroud-side inlet, and the swirl velocity of the rotor blade front edge decreases in proportion to the radium ratio to be equal to a circumferential velocity C', the hub-side inlet flows into the rotor blade 207 at a relative flow velocity B' greater than the relative flow velocity B of the shroud-side inlet.

Therefore, the flow coming in from the hub-side inlet has a higher flow velocity than the flow coming in from the shroud-side inlet, and the degree of reaction, which is a value representing the proportion of the amount of energy released inside the rotor blade 207 of all the energy released from the flow when passing through the turbine, is smaller for the hub-side flow.

That is, the shroud-side flow has a high degree of reaction, and the flow velocity inside the rotor blade can be reduced and the friction loss can be reduced, thereby providing a so-called "reaction turbine" characteristic, which realizes a high-efficiency flow.

On the other hand, the hub-side flow has a small degree of reaction and rotates the rotor blade 207 with a force resulting from the change of direction of the momentum when the high-velocity flow is turned by the rotor blade 207, and there is a large friction loss because the flow is accelerated to a high velocity, and the efficiency cannot be increased as high as that of the reaction blade, but there is provided a so-called "impulse turbine" characteristic where a power similar to that obtained by a large-diameter reaction blade can be generated with a small-diameter rotor blade.

In other words, a mixed flow turbine having such a configuration where the rotor blade 207 receives flows from the shroud-side inflow passageway 245 and the hub-side inflow passageway 241 shown in FIG. 17 can be said to be formed by hub-side impulse blades and shroud-side reaction blades.

Thus, since the flow coming in from the shroud side has a low inter-blade flow velocity, the friction loss is low, and the conversion to the rotational power is done by releasing the angular momentum as the radius varies; therefore, the efficiency of the rotor blade 207 is high, and at the rotor blade outlet where turning to the axial direction has been done, the swirl velocity is converted to a rotational power through the pressure change and by turning the flow direction.

On the other hand, with the hub-side impulse blade, the flow comes into the rotor blade 207 at a high velocity, and the swirl velocity of the flow is converted to a rotational power by turning the flow direction while maintaining the velocity at a high velocity; therefore, the incidence needs to be small, and a sufficient number of blades is needed for turning the direction of the high-velocity flow.

Thus, conventional mixed flow turbines have a problem in that the number of blades is small, and the high-velocity flow cannot be turned efficiently.

With the foregoing technical problems of conventional mixed flow turbines in view, it is an object of the present invention to provide a mixed flow turbine formed by a hub-side impulse blade portion and a shroud-side reaction blade portion, in which an intermediate blade having an intermediate height is provided in the hub-side portion having an impulse blade turbine characteristic so as to improve the impulse blade turbine characteristic and reduce the moment of inertia for the rotor blades as a whole, thereby improving the efficiency and improving the transient response.

In order to achieve such an object, the present invention provides a mixed flow turbine including: a turbine rotor blade having a front edge, through which a fluid flows in, the front edge being shaped so that a middle portion thereof between a hub side and a shroud side is formed so as to protrude toward an upstream side past a line extending between the hub side and the shroud side; a turbine housing formed to cover the turbine rotor blade and including a scroll portion for supplying the fluid toward the front edge of the rotor blade; a scroll partition wall dividing the scroll portion into a shroud-side space and a hub-side space; a shroud-side inflow passageway formed between a shroud-side partition wall surface on an inner periphery side of the scroll partition wall and a portion opposing the shroud-side partition wall surface, the fluid flowing through the shroud-side inflow passageway in a generally radial direction to a shroud-side inlet of the rotor blade; and a hub-side inflow passageway formed between a hub-side partition wall surface on an inner periphery side of the scroll partition wall and a portion opposing the hub-side partition wall surface, the fluid flowing through the hub-side inflow passageway in a direction generally equal to an inclination direction of a hub to a hub-side inlet of the rotor blade, the turbine rotor blade including: a plurality of main blades formed to stand upright in a circumferential direction on a hub outer circumferential surface, and having a height spanning an entire extent between the hub outer circumferential surface and an inner periphery surface of a shroud portion; and intermediate blades arranged in the circumferential direction between the main blades and arranged so as to extend from an inlet portion of the main blades to an intermediate portion, and having an intermediate height with respect to the height of the main blades, the fluid from the hub-side inflow passageway being allowed to flow in through front edges of the intermediate blades.

According to such an invention, the front edge, through which the fluid flows in, is shaped so that the middle portion thereof between the hub side and the shroud side is formed so as to protrude toward the upstream side past a line (line m in FIG. 1) extending between the hub side and the shroud side, as shown in FIG. 1.

The mixed flow turbine having the shroud-side inflow passageway and the hub-side inflow passageway with the scroll partition wall can be said to be formed by the impulse blade portion on the hub side and the reaction blade portion on the shroud side, as described above; therefore, if intermediate blades are arranged in the circumferential direction between main blades so that each intermediate blade extends from the inlet portion of the main blade to an intermediate portion with an intermediate height with respect to the height of the main blades, and the fluid from the hub-side inflow passageway is made to flow in to the front edge of the intermediate blades, the number of blades in the impulse turbine characteristic portion on the hub side can be increased without increasing the number of reaction blades having a large radius.

Therefore, for the problem that a high-velocity flow cannot be efficiently converted to a torque with a conventional mixed flow turbine since the number of blades is small, it is possible with the present invention to improve the efficiency and the transient response of a mixed flow turbine, without increasing the moment of inertia of the turbine rotor blade, by generating an amount of power per unit flow rate that is generally equal to the reaction blade portion of a large radius by using the impulse blade portion of a small radius, thus effectively utilizing the so-called "impulse turbine" characteristic.

Preferably, in the present invention, the intermediate blade is provided at least across an area, in a meridional shape of the turbine rotor blade, where an extension area of a passageway width of the hub-side inflow passageway overlaps an extension area of the shroud-side inflow passageway.

With such a configuration, if the intermediate blade is present in the extension area of the passageway width of the hub-side inflow passageway, in the meridional shape of the turbine rotor blade, it is possible to efficiently receive the flow from the hub-side inflow passageway and to exert the so-called "impulse turbine" characteristic. However, if the rear edge of the intermediate blade is provided to extend excessively on the downstream side, the inter-blade passageway of the main blade is narrowed, and the flow velocity is locally increased or decreased, thereby increasing the passageway loss; therefore, it needs to be within such an extent that the loss is not incurred. Accordingly, the rear edge of an intermediate blade 39 can be provided so as to extend to a substantially intermediate point of the entire extent from the main blade front edge to the rear edge where the flow from the shroud-side inflow passageway can be received, thus suppressing the passageway loss due to the intermediate blade.

Preferably, in the present invention, a plurality of the intermediate blades are arranged in the circumferential direction between the main blades.

By arranging a plurality of intermediate blades between the main blades as described above, it is possible to reduce the number of main blades while maintaining the efficiency of the mixed flow turbine, and to further reduce the moment of inertia of the turbine rotor blade.

Where a plurality of intermediate blades are provided, the rear edge positions may be different from one another.

Preferably, in the present invention, the front edge of the intermediate blade coincides with a front edge of the main blade, while a blade height of the front edge is set to a position substantially equal to, or higher than, a center line on a meridional plane that divides a flow along the main blade into passageway areas of a flow through a shroud-side passageway and a flow through a hub-side passageway on the basis of a ratio between the passageway width of the shroud-side inflow passageway and the passageway width of the hub-side inflow passageway, and a blade height of a rear edge is set to a position higher than the front edge.

If the front edge of the intermediate blade coincides with the front edge of the main blade, while the blade height of the front edge is set to a position substantially equal to, or higher than, the center line, as described above, the load on the blade front edge in the impulse blade portion on the hub side can be uniformly received by individual blades (individual blades of the main blades and the intermediate blades).

If the hub-side flow rate increases during acceleration as the blade height of the rear edge is provided at a height higher than the blade height of the front edge, the increase in the flow rate can be reliably received by the intermediate blade, thereby effectively exerting the impulse blade characteristic, thus improving the transient response (see FIG. 4).

While the turbocharger is in normal operation, a control is performed such that the flow rate of the shroud side having a reaction blade characteristic increases, in which case the angular momentum of the shroud-side flow can be received by the rear edge portion of the intermediate blade and converted to torque power. Therefore, it is possible to obtain a high efficiency advantage (see FIG. 5).

Therefore, even if the balance between the flow rate on the shroud side and the flow rate on the hub side is shifted, and the flow rate on the shroud side increases or the flow rate on the hub side increases, the intermediate blade has a function as a reaction blade for converting the angular momentum of the shroud-side flow to power when the flow rate on the shroud side increases whereas the intermediate blade has a function as an impulse blade when the flow rate on the hub side increases, thus functioning as a high-efficiency turbine in the former case and as a turbine with a high rotational acceleration in the latter case. Thus, it is possible to realize both the effect of improving the transient response of the engine and the high-efficiency operation during normal operation.

Preferably, in the present invention, a front edge of the intermediate blade is provided at a position less than a front edge radius of the main blade, and a blade height of the intermediate blade across an entire extent from upstream to downstream is maintained constantly at a position at a substantially equal height to, or higher than, a height of a center line on a meridional plane that divides a flow along the main blade into passageway areas of a flow through a shroud-side passageway and a flow through a hub-side passageway on the basis of a ratio between the passageway width of the shroud-side inflow passageway and the passageway width of the hub-side inflow passageway.

As the front edge of the intermediate blade is provided at a position less than the front edge radius of the main blade, and moreover the height of the intermediate blade across the entire extent of the intermediate blade from upstream to downstream is maintained constantly at a position at a substantially equal height to, or higher than, the height of the center line, as described above; thus, by limiting the position of the front edge of the intermediate blade and the blade height across its entire extent, the size of the intermediate blade in the radial direction can be decreased, and the moment of inertia of the turbine rotor blade can be decreased.

Preferably, in the present invention, a front edge of the intermediate blade is provided at a position less than a front edge radius of the main blade, while a blade height of the intermediate blade across an entire extent from an upstream to downstream is set to a position higher than a center line on a meridional plane that divides a flow along the main blade into passageway areas of a flow through a shroud-side passageway and a flow through a hub-side passageway on the basis of a ratio between the passageway width of the shroud-side inflow passageway and the passageway width of the hub-side inflow passageway, and a blade height of a rear edge is set to a position higher than the front edge.

Since the blade height of the rear edge of the intermediate blade is provided at a position higher than the front edge, as described above, even if the balance between the flow rate on the shroud side and the flow rate on the hub side is shifted, and the flow rate on the shroud side increases or the flow rate on the hub side increases, as described above, the intermediate blade has a function as a reaction blade for converting the angular momentum of the shroud-side flow to power when the flow rate on the shroud side increases whereas the intermediate blade has a function as an impulse blade when the flow rate on the hub side increases, thus functioning as a high-efficiency turbine in the former case and as a turbine with a high rotational acceleration in the latter case. Thus, it is possible to realize both the effect of improving the transient response of the engine and the high-efficiency operation during normal operation.

Moreover, since the front edge of the intermediate blade is provided at a position less than the front edge radius of the main blade, the size of the intermediate blade in the radial direction can be decreased, and a reduction in the moment of inertia of the turbine rotor blade can be further achieved.

Moreover, preferably, in the present invention, a radius of the front edge of the intermediate blade is set to a radius substantially equal to a radius at which the intermediate blade is attached to the hub, in which case it is possible to further reduce the moment of inertia of the turbine rotor blade.

Since the front edge radius of the intermediate blade is set to a radius substantially equal to the radius at which the intermediate blade is attached to the hub, there is also an advantage of stabilizing the fixing of the intermediate blade to the hub outer surface.

Preferably, in the present invention, the front edge of the intermediate blade coincides with a front edge of the main blade, and a blade height of the intermediate blade gradually decreases toward a rear edge.

With such a configuration, the function of the impulse blade on the hub side can be primarily provided by the front edge side of the intermediate blade, thereby reducing the passageway resistance in areas downstream of the intermediate blade, and contributing to the reduction of the moment of inertia.

Preferably, in the present invention, a blade tip of the intermediate blade is formed to have an arc-shaped cross section.

FIG. 11 is a cross-sectional view taken along I-I of FIG. 3, and the streamline R of the shroud-side flow of the fluid flowing into the main blade flows so as to cross the blade tip of the intermediate blade as shown in FIG. 11.

Therefore, the blade tip of the intermediate blade needs to have a function as a blade front edge, and by forming the blade tip of the intermediate blade so as to have an arc-shaped cross section, it is possible to prevent the flow crossing the tip of the intermediate blade from delaminating at the suction surface of the intermediate blade, thereby increasing the loss.

Preferably, in the present invention, a blade front edge wedge angle, which is formed between a pressure surface and a suction surface of front edges of the main blade and intermediate blade, is set to an angle corresponding to a change in an inflow angle of the fluid to the front edge, which changes following a pressure oscillation of the fluid, and setting is also implemented such that an inflow direction to the front edge when the pressure oscillation increases toward a high-pressure side generally coincides with a tangential direction of the suction surface or is oriented further toward a pressure surface side than the tangential direction.

As shown in FIG. 13, when the engine is equipped with a turbocharger, the pressure of the exhaust gas flowing into the turbine inlet varies depending on the number of cylinders of the reciprocating engine or the degree of acceleration. When this pressure oscillation occurs, a change in the absolute flow velocity that is equivalent to the change in the pressure oscillation occurs in a hub-side impulse turbine portion, and as a result, the inflow angle to the rotor blade often varies.

Therefore, as shown in FIG. 14, as the front edge opening angle between the front edge portions of the main blade and the intermediate blade is set to an angle corresponding to a change in an inflow angle of the fluid to the front edge, which changes following a pressure oscillation of the fluid, it is possible to prevent an increase in the loss of flow, in the front edge portion of the intermediate blade and the main blade, following a pressure oscillation of the fluid, and to increase the efficiency.

Moreover, since the setting is such that the inflow direction to the front edge when the pressure oscillation increases toward a high-pressure side generally coincides with a tangential direction of the suction surface or is oriented toward the pressure surface side, it is possible to prevent the delamination of the flow at the suction surface, and to reduce the loss of flow in the impulse blade portion following a pressure oscillation of the fluid, thereby increasing the efficiency.

Preferably, in the present invention, the cross-sectional profile of a front edge portion of the main blade in a normal cross section to a rotating shaft is formed by curving the front edge portion of the main blade in a direction of rotation to have a shape to protrude in an opposite direction to the direction of rotation.

As shown in FIG. 15, the circumferential velocity U decreases corresponding to the radius of rotation, and the swirl velocity Vc, which is the circumferential direction component of the absolute flow velocity V, increases as the radius decreases because it flows radially inward while satisfying the relationship of a free vortex; as a result, the flow is implemented at the relative flow velocity W so as to hit the blade from the direction of rotation near the blade front edge of the main blade (see FIG. 15). Once the fluid goes inside of the blade front edge, the relative flow velocity W moves toward the blade while changing its direction toward the direction of rotation. Therefore, the blade load increases.

Thus, in the blade front edge portion, if the center line of the blade front edge is curved in the direction of rotation so as to protrude in the opposite direction to the direction of rotation, once it goes inside of the blade front edge, the flow moving toward the blade while the relative flow velocity W changes its direction toward the direction of rotation does not flow in to hit the blade but flows along the blade; therefore, it is possible to reduce the collision loss at the blade front edge and reduce the blade load.

Thus, it is possible to accommodate the problem in which the load on the blade front edge of the main blade increases which occurs as the number of main blades is reduced.

Preferably, in the present invention, it includes, in the hub-side inflow passageway, a nozzle formed by a blade surface parallel to a central axis, and a guide plate arranged on a downstream side of the nozzle so that a rear edge opposes the front edge of the rotor blade.

With such a configuration, the flow of the fluid flowing through the hub-side inflow passageway into the intermediate blade front edge accelerates or becomes an ideal swirl flow, and it is therefore possible to increase the velocity of the inflow to a portion of the rotor blade having a so-called "impulse turbine" characteristic, thereby improving the transient response.

According to the present invention, there is provided a mixed flow turbine, wherein a front edge, through which a fluid flows in, is shaped so that a middle portion thereof between a hub side and a shroud side is formed so as to protrude toward an upstream side past a line extending between the hub side and the shroud side, and a shroud-side inflow passageway and a hub-side inflow passageway are formed by a scroll partition wall; intermediate blades having an intermediate height are provided between main blades in a hub-side portion of a turbine rotor blade exerting an impulse blade turbine characteristic, thus improving the impulse blade turbine characteristic and reducing the moment of inertia for the rotor blade as a whole, thereby improving the efficiency and improving the transient response.

BEST MODE FOR CARRYING OUT THE INVENTION

Embodiments of the present invention will now be described in detail with reference to the drawings. Note that unless specifically stated otherwise, the dimensions, materials, shapes, relative arrangements of the components described in the following embodiments are merely illustrative and are not intended to limit the scope of this invention thereto.

First Embodiment

A first embodiment of the present invention will now be described with reference to FIGS. 1 and 2.

A mixed flow turbine 1 of the present invention will be described in examples for use in superchargers (turbochargers) of vehicle engines.

Figure 1:
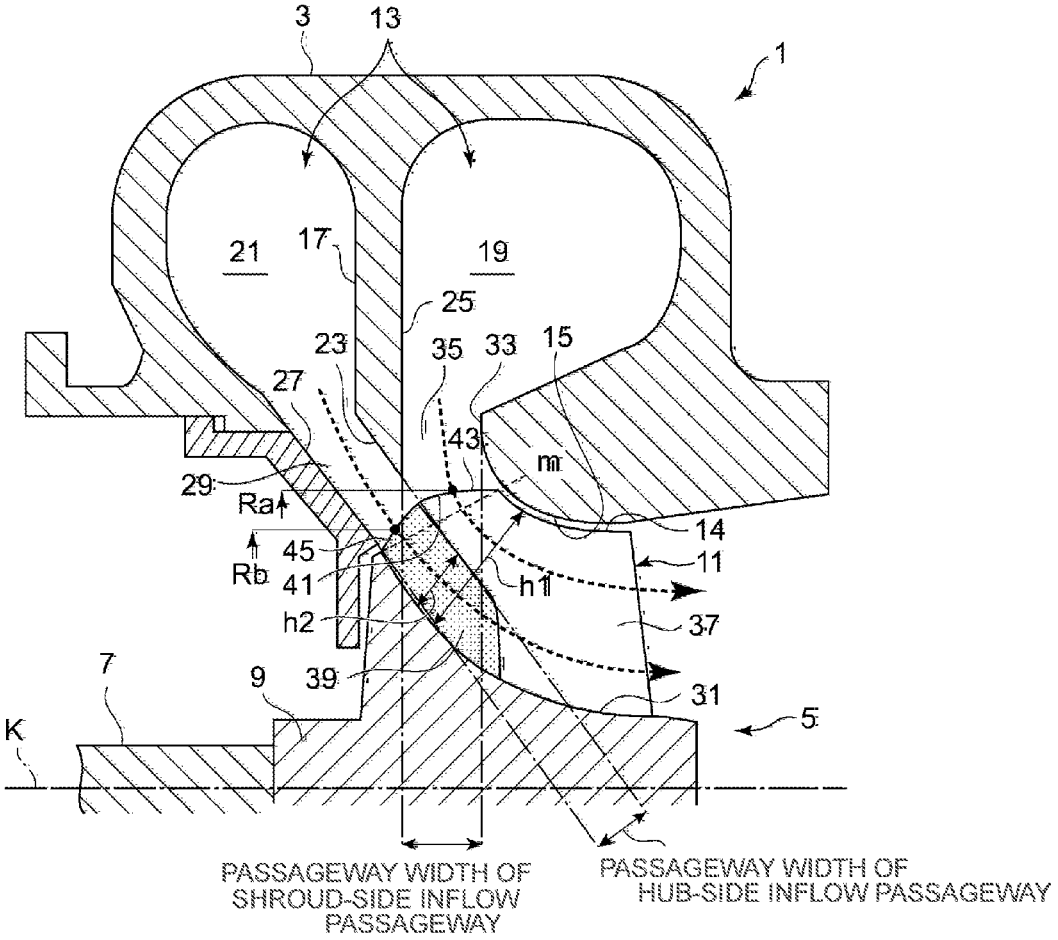
FIG. 1 is a cross-sectional view of an important part of a mixed flow turbine according to a first embodiment of the present invention.

In FIG. 1, the mixed flow turbine 1 includes a turbine housing 3, and a turbine wheel 5 rotatably supported and accommodated in the turbine housing 3. The turbine wheel 5 includes a rotating shaft 7, a hub 9 integral or welded with the rotating shaft 7, a turbine rotor blade (rotor blade) 11 provided standing on the outer circumferential surface of the hub 9, wherein a snail-shaped scroll chamber (scroll portion) 13 formed in the turbine housing 3 creates a swirl flow having a velocity around the central axis K of the rotating shaft 7, and the swirl flow swirls on the outer circumferential side of the turbine wheel 5.

The rotating shaft 7 is supported in a bearing housing with a bearing (not shown). The turbine wheel 5 is attached at one end of the rotating shaft 7, with the rotating shaft of the turbocompressor connected at the other end, and the turbocompressor is rotated via the rotating shaft 7 which is rotated by the exhaust gas (fluid) from the engine via the turbine wheel 5, thereby compressing and supplying the intake air to the engine.

A shroud portion 15 covering a radial outer edge 14 of the rotor blade 11 is formed on the outer circumferential side of the turbine wheel 5 of the turbine housing 3.

A scroll partition wall 17 projecting in the radial direction from the outer side toward the inner side is provided inside the turbine housing 3. The scroll chamber 13 is divided by the scroll partition wall 17 into a shroud-side space 19 and a hub-side space 21.

The hub side of the inner periphery side of the scroll partition wall 17 forms a hub-side partition wall surface 23 that is inclined so as to be tapered toward the shroud side. The shroud side of the inner periphery side of the scroll partition wall 17 forms a shroud-side partition wall surface 25 extending in a generally radial direction.

A hub-side wall surface 27 which is a hub-side member opposing the hub-side partition wall surface 23 on the hub side of the turbine housing 3 is formed so as to be generally parallel to the hub-side partition wall surface 23, and a hub-side inflow passageway 29 is formed between the hub-side wall surface 27 and the hub-side partition wall surface 23.

The hub-side inflow passageway 29 has an inclination direction generally equal to the inclination direction of the upstream end of a hub outer circumferential surface 31 of the hub 9.

A shroud-side wall surface 33 opposing the shroud-side partition wall surface 25 on the shroud side of the turbine housing 3 is formed so as to be generally parallel to the shroud-side partition wall surface 25, and a shroud-side inflow passageway 35 is formed between the shroud-side wall surface 33 and the shroud-side partition wall surface 25.

Since the shroud-side partition wall surface 25 extends in a generally radial direction, the shroud-side inflow passageway 35 extends in a generally radial direction.

The rotor blade 11 is a plate-shaped member, and is provided standing on the hub outer circumferential surface 31 so that the surface portion thereof extends in the axial direction. As shown in FIG. 2, the rotor blade 11 includes: a plurality of main blades 37 arranged in the circumferential direction standing on the hub outer circumferential surface 31 with a height spanning the entire extent between the hub outer circumferential surface 31 and the inner periphery surface of the shroud portion 15; and intermediate blades 39 arranged in the circumferential direction between adjacent main blades 37 and arranged so as to extend from the inlet portion of the main blades 37 to an intermediate portion with an intermediate height with respect to the height of the main blades 37.

The intersection between a front edge 41 of the main blade 37 and the radial outer edge 14 is located on the outer side in the radial direction with respect to the intersection between the hub 9 and the front edge 41.

The main blade 37 includes the front edge 41 located on the upstream side in the flow direction of the exhaust gas. The front edge 41 is formed by a curved line that is smoothly bulging in a protruding shape across its entire extent toward the upstream side as shown in FIG. 1.

That is, the front edge 41, through which the fluid flows in, is shaped so that the middle portion thereof between the hub side and the shroud side is formed so as to protrude toward the upstream side past a line m extending between the hub side and the shroud side.

The shroud-side portion of the front edge 41 is shaped so as to extend along generally the same radial position, i.e., generally orthogonal to the radial direction. The shroud-side portion of the front edge 41 forms a shroud-side inlet 43, and a hub-side portion thereof forms a hub-side inlet 45. The shroud-side inlet 43 has a center radius Ra, and the hub-side inlet 45 has a center radius Rb.

As shown in FIG. 1, the intermediate blade 39 is provided at least across an area, in the meridional shape, where the extension area of the passageway width of the hub-side inflow passageway 29 overlaps the extension area of the shroud-side inflow passageway 35. In the present embodiment, it is formed substantially across the entirety of the overlapping area.

That is, the front edge of the intermediate blade 39 coincides with the shape of the front edge of the main blade 37, the intermediate blade height h2 is equal to the passageway width of the hub-side inflow passageway 29, and is an intermediate height with respect to the blade height h1 of the main blade 37. The rear edge of the intermediate blade 39 is formed to substantially coincide with, or to be slightly longer than, the rear edge portion of the extension area of the shroud-side inflow passageway 35.

With the presence of the intermediate blade 39 in the extension area of the passageway width of the hub-side inflow passageway 29, it is possible to efficiently receive the flow from the hub-side inflow passageway 29 and to exert the so-called "impulse turbine" characteristic. However, if the rear edge of the intermediate blade 39 is provided to extend excessively on the downstream side, the flow velocity is locally increased or decreased, and the inter-blade passageway between the main blades 37 is narrowed, thereby increasing the passageway loss; therefore, it needs to be within such an extent that the loss is not incurred. Accordingly, the rear edge of the intermediate blade 39 is provided so as to extend to a substantially intermediate point of the entire extent from the main blade front edge to the rear edge where the flow from the shroud-side inflow passageway 35 can be received, thus suppressing the passageway loss due to the intermediate blade 39.

By shaping the intermediate blades 39 as described above, the number of blades in the hub-side impulse turbine characteristic portion can be increased without increasing the number of reaction blades having a large radius. This makes it possible to effectively utilize the hub-side portion having a so-called "impulse turbine" characteristic.

Therefore, for the problem that a high-velocity flow cannot be efficiently converted to a torque with a conventional mixed flow turbine since the number of blades is small, it is possible to improve the efficiency and the transient response of a mixed flow turbine by suppressing the increase in the moment of inertia of the turbine rotor blade by, for example, increasing the intermediate blades without increasing the number of main blades, or decreasing the number of main blades and increasing the number of intermediate blades.

Figure 17:
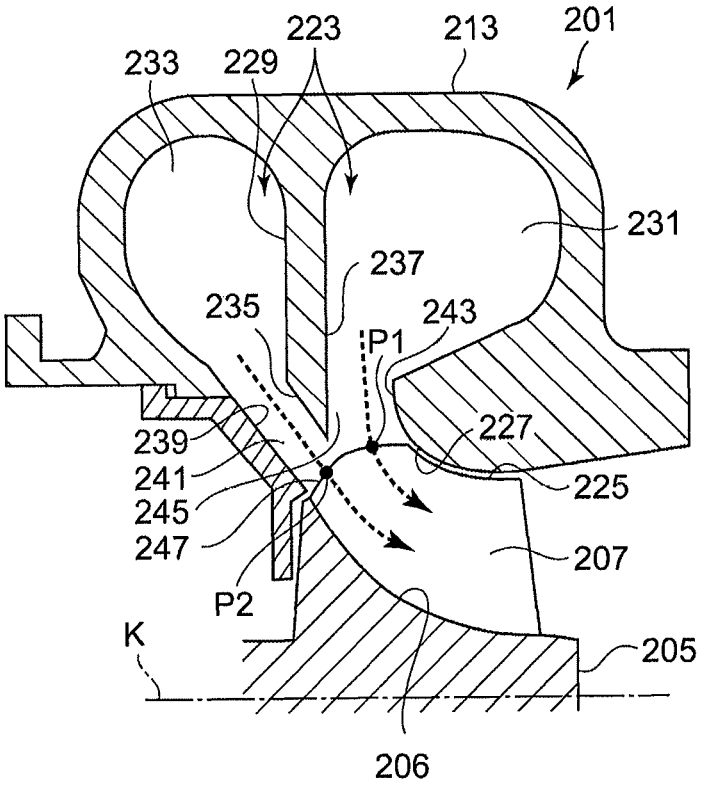
FIG. 17 shows a meridional shape of a conventional mixed flow turbine.

While the hub-side impulse turbine characteristic and the shroud-side reaction turbine characteristic have already been described based on FIG. 17 and FIG. 18, they will be described again based on the configuration of FIG. 1 with reference to the velocity triangle of FIG. 18.

Figure 18:
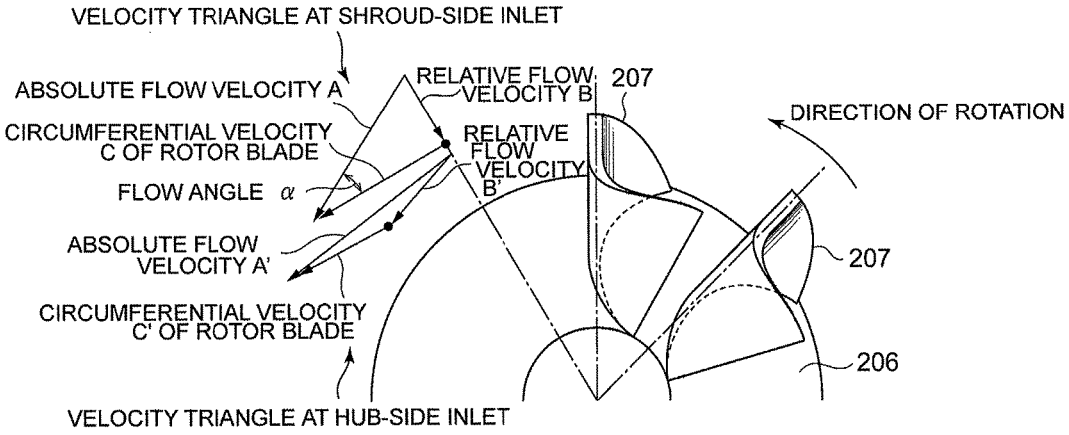
FIG. 18 shows a perspective shape of a turbine wheel and velocity triangles of a conventional mixed flow turbine.

In FIG. 1, the flow coming in from the shroud-side inflow passageway 35 flows into the rotor blade 11 at the flow velocity A with a flow angle $\alpha$ shown in FIG. 18 being about 20 to 30 degrees. The circumferential velocity C is a velocity that substantially coincides with the circumferential swirl velocity of the rotor blade 11, and the radial velocity, which is the relative flow velocity B, is a velocity representative of the flow rate.

The flow coming in from the shroud-side inflow passageway 35 does work on the rotor blade 11 as the radius varies inside the rotor blade 11, and flows out toward the discharge port while the circumferential velocity lowers and the pressure lowers.

On the other hand, the flow coming in from the hub-side inflow passageway 29 flows into the hub-side inlet 45 at a flow velocity A' greater than the shroud-side inlet 43 since the radius Rb of the hub-side inlet 45 is smaller than the radius Ra of the shroud-side inlet 43, and the flow coming from the shroud-side inlet flows into an area of a small radius and flows into a position where the pressure has decreased.

Since the radius Rb of the hub-side inlet 45 is smaller than the radius Ra of the shroud-side inlet 43, and the swirl velocity of the rotor blade front edge decreases in proportion to the radium ratio to be equal to a circumferential velocity C', the flow in the hub-side inlet 45 flows into the rotor blade 11 at a relative flow velocity B' greater than the relative flow velocity B of the shroud-side inlet 43 of the turbine rotor blade 11.

Therefore, the flow coming in from the hub-side inlet 45 has a higher flow velocity than the flow coming in from the shroud-side inlet 43, and the degree of reaction, which is a value representing the proportion of the amount of energy released inside the rotor blade 11 of all the energy released from the flow when passing through the turbine, is smaller for the hub-side flow.

That is, the shroud-side flow has a high degree of reaction, and the flow velocity inside the rotor blade can be reduced and the friction loss can be reduced, thereby providing a so-called "reaction turbine" characteristic, which realizes a high-efficiency flow.

On the other hand, the hub-side flow has a small degree of reaction and rotates the rotor blade 11 with a force resulting from the change of direction of the momentum when the high-velocity flow is turned by the rotor blade 11, and there is a large friction loss because the flow is accelerated to a high velocity, and the efficiency cannot be increased as high as that of the reaction blade, but there is provided a so-called "impulse turbine" characteristic where a power similar to that obtained by a large reaction blade can be generated with a small-diameter rotor blade.

Figure 2:
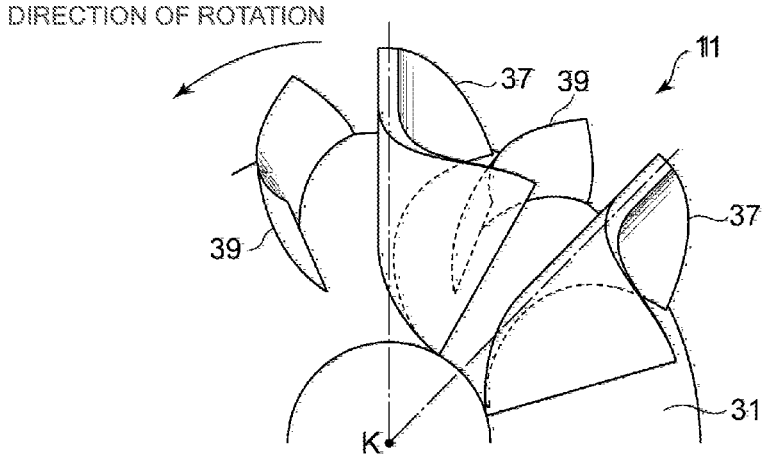
FIG. 2 is a perspective view illustrating a turbine rotor blade of a mixed flow turbine according to the first embodiment.

Note that while an example where one intermediate blade 39 is provided between main blades 37 is illustrated as shown in FIG. 2, a plurality of intermediate blades 39 may be arranged in the circumferential direction. Where a plurality of intermediate blades 39 are provided, the rear edge positions of the intermediate blades 39 may be different from one another. By providing a plurality of intermediate blades 39 between main blades 37 as described above, it is possible to further reduce the number of main blades 37 while maintaining the efficiency of the mixed flow turbine, and to further reduce the moment of inertia of the turbine rotor blade 11.

Second Embodiment

Next, referring to FIG. 3 to FIG. 5, a second embodiment will be described.

The second embodiment is a variation of the meridional shape of the intermediate blade 39 of FIG. 1, and an intermediate blade 47 of the second embodiment is such that the height of the rear edge portion is higher than the front edge portion.

Figure 3:
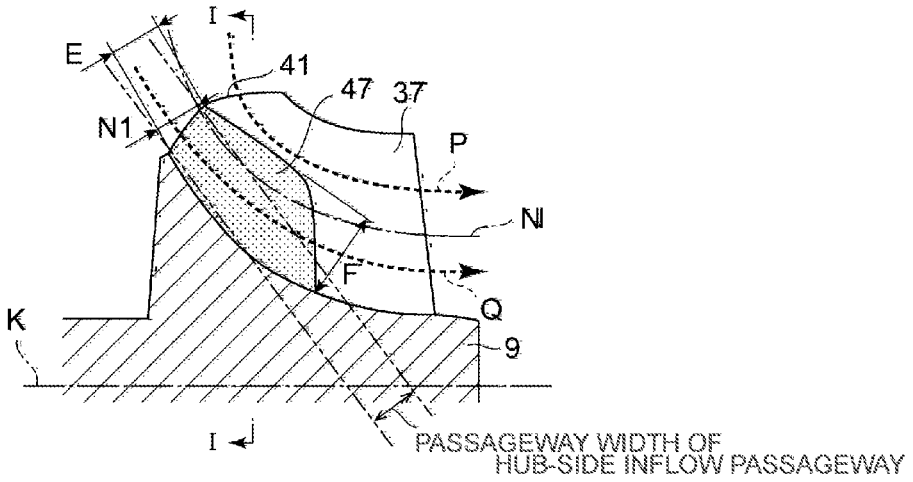
FIG. 3 shows a meridional shape of a mixed flow turbine according to a second embodiment.
Figure 4:
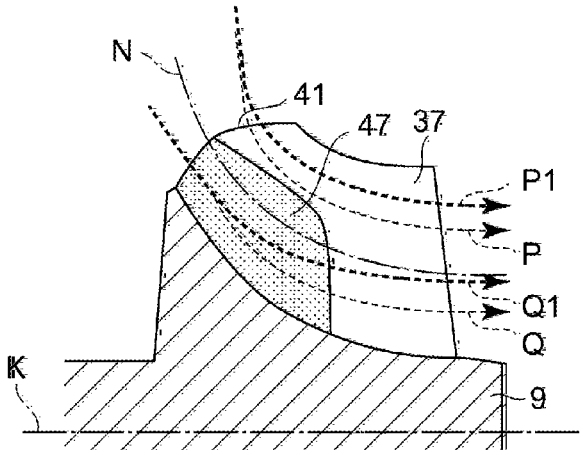
FIG. 4 is a diagram illustrating a case where the flow rate through the hub-side passageway has increased according to the second embodiment.

The line N of FIG. 3 denotes a center line on the meridional plane that divides the flow along the main blade 37 into passageway areas of the flow through the shroud-side passageway and the flow through the hub-side passageway based on the ratio between the passageway width of the shroud-side inflow passageway 35 and the passageway width of the hub-side inflow passageway 29.

The line P denotes the center line of the flow through the shroud-side passageway, and the line Q denotes the center line of the flow through the hub-side passageway.

Then, the front edge of the intermediate blade 47 coincides with the front edge 41 of the main blade 37, while the blade height E of the front edge of the intermediate blade is set to a position substantially equal to the height N1 of the center line N or slightly higher than the center line N, and the blade height F of the rear edge of the intermediate blade 47 is set to a position higher than the front edge (E<F).

Thus, as the front edge of the intermediate blade 47 coincides with the front edge of the main blade 37, while the blade height E of the front edge of the intermediate blade 47 is set to a position substantially equal to or slightly higher than the height N1 of the center line N, the load on the hub-side blade front edge portion exerting the impulse blade characteristic can be received equally by individual blades (individual blades of the main blades 37 and the intermediate blades 47).

Since the blade height F of the rear edge is provided at a position higher than the blade height E of the front edge (E<F), if the hub-side flow rate increases during acceleration, and the center line P of the flow through the shroud-side passageway and the center line Q of the flow through the hub-side passageway are both shifted toward the shroud side to be P1 and Q1, respectively, the center line Q1 of the flow through the hub-side passageway can be reliably received by the intermediate blade 47 (see FIG. 4), thus allowing the intermediate blade 47 to function effectively as one with an impulse blade characteristic, improving the transient response.

Figure 5:
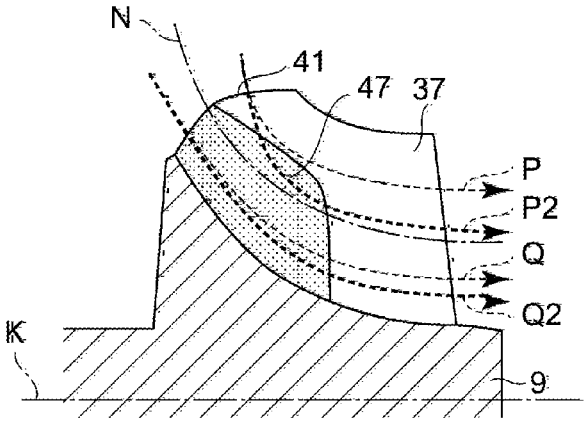
FIG. 5 is a diagram illustrating a case where the flow rate through the shroud-side passageway has increased according to the second embodiment.

Moreover, while the turbocharger is in normal operation, a control is performed such that the flow rate of the shroud side having a reaction blade characteristic increases, in which case the center line P of the flow through the shroud-side passageway and the center line Q of the flow through the hub-side passageway are both shifted toward the hub side to be P2 and Q2, respectively, but the shroud-side flow can be received by the rear edge portion of the intermediate blade 47, and the angular momentum can be converted to torque power (see FIG. 5). Therefore, it is possible to allow the intermediate blade 47 to function as one with a reaction blade characteristic to thereby obtain a high efficiency advantage.

That is, even if the balance between the flow rate on the shroud side and the flow rate on the hub side is shifted, and the flow rate on the shroud side increases or the flow rate on the hub side increases, the intermediate blade 47 has a function as a reaction blade for converting the flow angle momentum on the shroud side to power when the flow rate on the shroud side increases whereas the intermediate blade 47 has a function as an impulse blade when the flow rate on the hub side increases, thus functioning as a high-efficiency turbine in the former case and as a turbine with a high rotational acceleration in the latter case. Thus, it is possible to realize both the effect of improving the transient response of the engine and the high-efficiency operation during normal operation.

Third Embodiment

Next, referring to FIG. 6, a third embodiment will be described.

Figure 6:
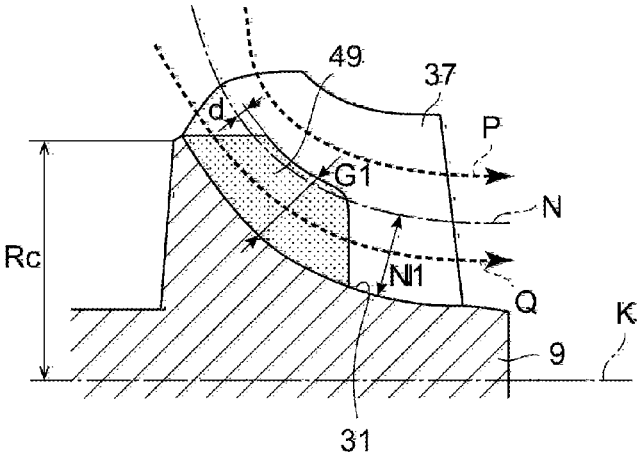
FIG. 6 shows a meridional shape of a mixed flow turbine according to a third embodiment.

The third embodiment is a variation of the meridional shape of the intermediate blade 39 of FIG. 1, wherein the front edge of an intermediate blade 49 of the third embodiment is provided at a position less than the front edge radius of the main blade 37, and the blade height G1 of the intermediate blade 49 across the entire extent from upstream to downstream is maintained constantly at a substantially equal height to the height N1 of the center line denoted by the line N of FIG. 6 or at a position slightly higher than the center line N.

As shown in FIG. 6, the front edge of the intermediate blade 49 is set to a radius substantially equal to the radius Rc at which the intermediate blade 49 is attached to the hub 9, and the blade height G1 is set to a height N1+d such that the center line N is included therein.

As in the first embodiment, the rear edge of the intermediate blade 49 is formed so as to substantially coincide with, or be slightly longer than, the rear edge portion of the extension area of the shroud-side inflow passageway 35.

According to the present embodiment, the front edge of the intermediate blade 49 is provided at a position less than the front edge radius of the main blade 37, and moreover the height G1 of the intermediate blade 49 is maintained constantly from upstream to downstream at a position slightly higher than the height of the center line N; thus, by limiting the position of the front edge of the intermediate blade 49 and the blade height across its entire extent, the size of the intermediate blade 49 in the radial direction can be made smaller than the intermediate blades 39 and 47 of the first and second embodiments, and the moment of inertia of the rotor blade 11 can be decreased.

Since the front edge radius of the intermediate blade 49 is set to a radius substantially equal to the radius Rc at which the intermediate blade 49 is attached to the hub 9, the fixing of the intermediate blade 49 to the hub outer circumferential surface 31 is stabilized.

Fourth Embodiment

Next, referring to FIGS. 7 to 9, a fourth embodiment will be described.

An intermediate blade 51 of the fourth embodiment is a variation to the blade height of the intermediate blade 49 of the third embodiment, wherein the rear edge is provided at a higher position than the front edge.

Figure 7:
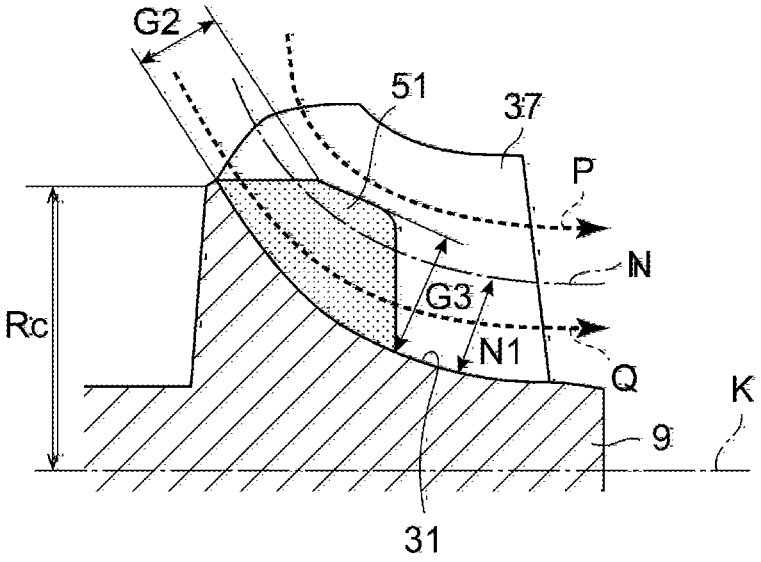
FIG. 7 shows a meridional shape of a mixed flow turbine according to a fourth embodiment.

As shown in FIG. 7, the front edge of the intermediate blade 51 is set to a radius substantially equal to the radius Rc at which the intermediate blade 51 is attached to the hub 9, and the blade height G2 is set to a height N1+d such that the center line N is included therein.

As in the first embodiment, the rear edge of the intermediate blade 51 is formed so as to substantially coincide with, or be slightly longer than, the rear edge portion of the extension area of the shroud-side inflow passageway 35. The blade height G3 of the rear edge is set to be higher than the front edge.

Figure 8:
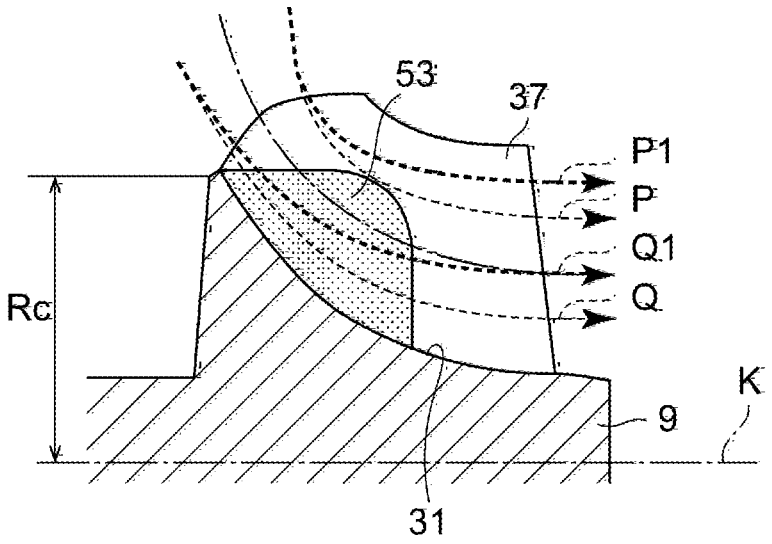
FIG. 8 shows a variation of an intermediate blade of the fourth embodiment.
Figure 9:
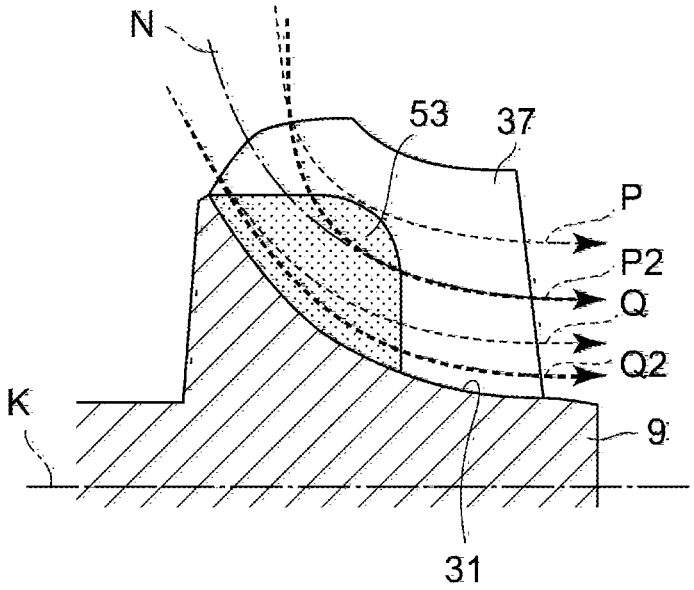
FIG. 9 is a diagram illustrating a change in the flow rate through the hub-side passageway and the shroud-side passageway according to the fourth embodiment.

Note that FIGS. 8 and 9 show a variation of FIG. 7, showing a case where the front edge of FIG. 7 extends constantly at the radius Rc so as to coincide with the rear edge. There is no intermediate portion between the front edge and the rear edge of this intermediate blade 53, and the intermediate blade 53 is shaped in a substantially triangular shape where the front edge and the rear edge intersect with each other.

Since the blade height G3 of the rear edge is provided at a position higher than the blade height G2 of the front edge (G2<G3), as shown in FIGS. 7 to 9, if the hub-side flow rate increases during acceleration, and the center line P of the flow through the shroud-side passageway and the center line Q of flow through the hub-side passageway are both shifted toward the shroud side to be P1 and Q1, respectively, the center line Q1 of the flow through the hub-side passageway can be reliably received by the intermediate blades 51 and 53 (see FIG. 8), thus allowing the intermediate blades 51 and 53 to function effectively as one with an impulse blade characteristic, improving the transient response.

Moreover, while the turbocharger is in normal operation, a control is performed such that the flow rate of the shroud side having a reaction blade characteristic increases, in which case the center line P of the flow through the shroud-side passageway and the center line Q of the flow through the hub-side passageway are both shifted toward the hub side to be P2 and Q2, respectively, but the shroud-side flow can be received by the rear edge portion of the intermediate blades 51 and 53, and the angular momentum can be converted to torque power (see FIG. 9). Therefore, it is possible to allow the intermediate blades 51 and 53 to function as one with a reaction blade characteristic to thereby obtain a high efficiency advantage.

That is, as in the second embodiment, it is possible to accommodate changes in the balance between the shroud-side flow rate and the hub-side flow rate, and since the radius is smaller as compared with the second embodiment, it is possible to reduce the moment of inertia of the intermediate blades 51 and 53, thus allowing for a further reduction of the moment of inertia of the rotor blade 11.

Fifth Embodiment

Next, referring to FIG. 10, a fifth embodiment will be described.

An intermediate blade 55 of the fifth embodiment has a front edge that coincides with the front edge of the main blade 37, with the blade height gradually decreasing toward the rear edge.

Figure 10:
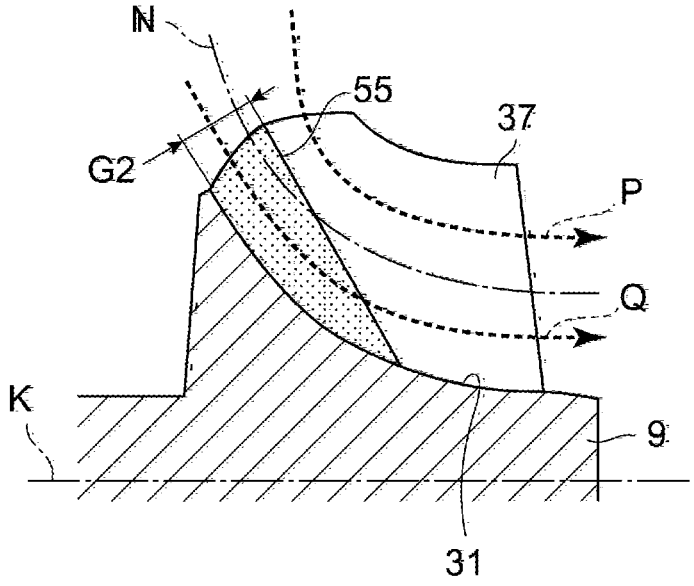
FIG. 10 shows a meridional shape of a mixed flow turbine according to a fifth embodiment.

As shown in FIG. 10, the front edge of the intermediate blade 55 coincides with the shape of the front edge of the main blade 37, and the front edge height G2 of the intermediate blade 55 is set to a position at a substantially equal height to the height N1 of the center line denoted by the line N of FIG. 10 or slightly higher than the center line N, whereas the rear edge of the intermediate blade 55 is formed so as to substantially coincide with the rear edge portion of the extension area of the shroud-side inflow passageway 35 so that the blade height gradually decreases from the front edge toward the rear edge.

According to the present embodiment, the function of the impulse blade on the hub side is primarily provided by the front edge side of the intermediate blade, thereby reducing the passageway resistance in areas downstream of the intermediate blade, and contributing to the reduction of the moment of inertia.

Sixth Embodiment

Next, referring to FIG. 11, a sixth embodiment will be described.

The sixth embodiment is where the front edge of the main blade 37 and the blade tip of the intermediate blade 39 (47, 49, 51, 53, 55) are shaped so as to have an arc-shaped cross section.

Figure 11:
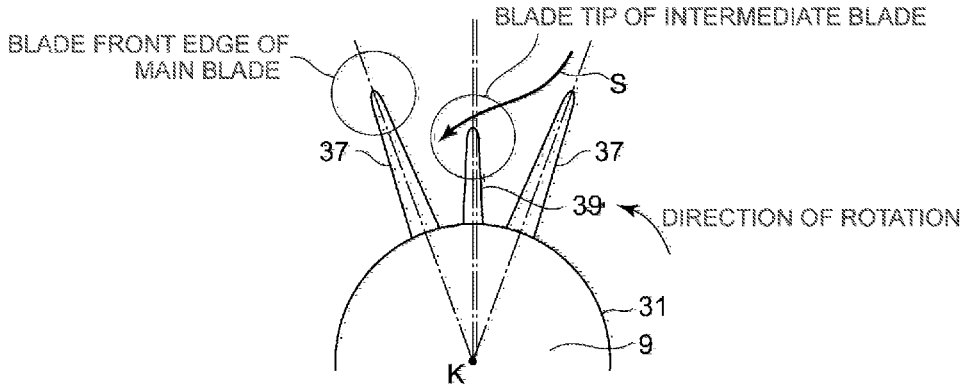
FIG. 11 is a cross-sectional view taken along I-I of FIG. 3 showing a mixed flow turbine according to a sixth embodiment.

FIG. 11 shows a cross-sectional view taken along line I-I of FIG. 3, where the front edge of the main blade 37 and the blade tip of the intermediate blade 39 are formed in an arc shape.

Since they are formed in an arc shape, the streamline S of the shroud-side flow flows so as to cross the blade tip of the intermediate blade 39 as shown in FIG. 11. Therefore, the blade tip of the intermediate blade 39 needs to have a function as a blade front edge, and by forming the blade tip of the intermediate blade 39, etc., so as to have an arc-shaped cross section, it is possible to prevent the flow crossing the tip of the intermediate blade 39, etc., from delaminating at the suction surface of the intermediate blade, thereby increasing the loss.

The rear edge of the intermediate blade 39, etc., has a shape obtained by connecting a substantially linear line, meaning the blade tip, to a line oriented in the radial direction with a curve, and there is no clear structural distinction between the blade tip and the rear edge; therefore, for the rear edge and a portion of the blade tip near the rear edge, the radius of the arc shape of the blade tip is desirably set to decrease downstream, and with such a setting, it is possible to prevent a wake from occurring at the rear edge and to contribute to preventing the efficiency from lowering.

Seventh Embodiment

Next, referring to FIGS. 12 to 14, a seventh embodiment will be described.

The seventh embodiment is directed to a cross section of a blade front edge, where the blade front edge wedge angle, which is formed by the pressure surface and the suction surface of the front edge of the main blade 37 and the intermediate blade 39 of the first embodiment, is set.

Figure 12:
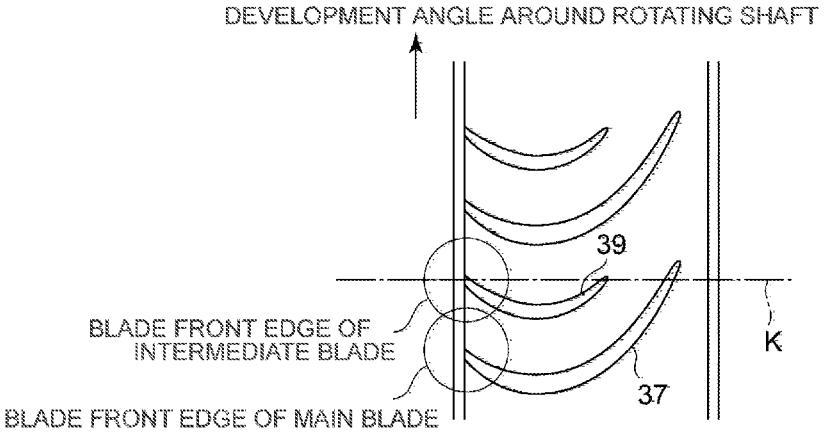
FIG. 12 is a cylindrical development view of a rotor blade shape illustrating a seventh embodiment.

FIG. 12 is a development view obtained by projecting, onto a cylinder of a representative radius (e.g., the radius Rc at which the rotor blade 11 is attached to the hub), the cross section of the main blades 37 and the intermediate blades 39 of the rotor blade 11 of the first embodiment taken along the hub outer circumferential surface 31 or a representative hub-side flow streamline.

Figure 14:
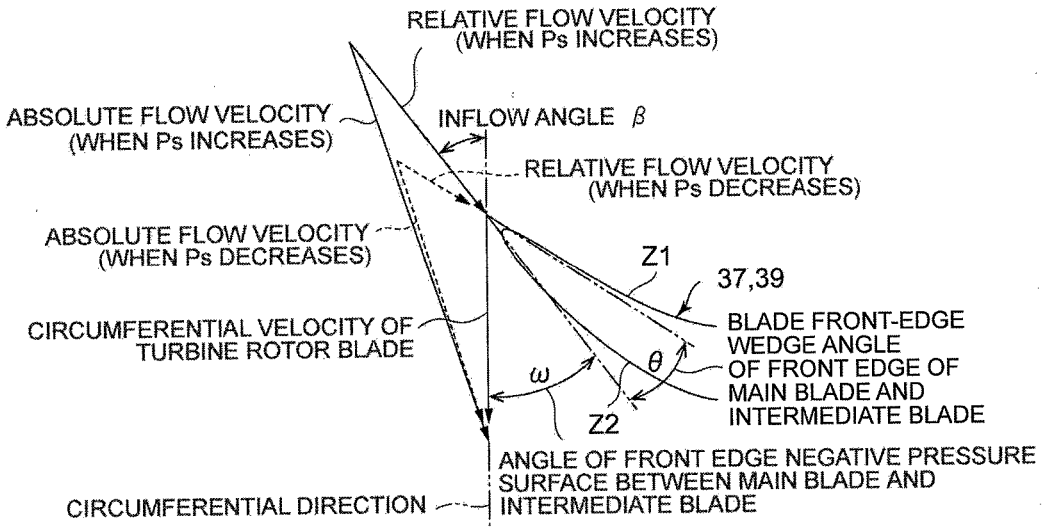
FIG. 14 is a diagram illustrating a blade front edge wedge angle of an intermediate blade of the seventh embodiment.

FIG. 14 shows an enlarged view of the blade front edge portion of FIG. 12, where the blade front edge wedge angle θ, which is the angle formed between the pressure surface Z1 and the suction surface Z2 of the front edge of the main blade 37 and the front edge of the intermediate blade 39, is set to an angle corresponding to the change in the inflow angle of the exhaust gas to the front edge, which changes following the pressure oscillation of the exhaust gas of the fluid.

That is, the blade front edge wedge angle θ is set to be the angle corresponding to the change in the inflow angle of the then relative flow velocity between when the turbine inlet pressure Ps increases and when it decreases following the pressure oscillation of the exhaust gas of the fluid, as shown in the inlet velocity triangle of the rotor blade 11.

Figure 13:
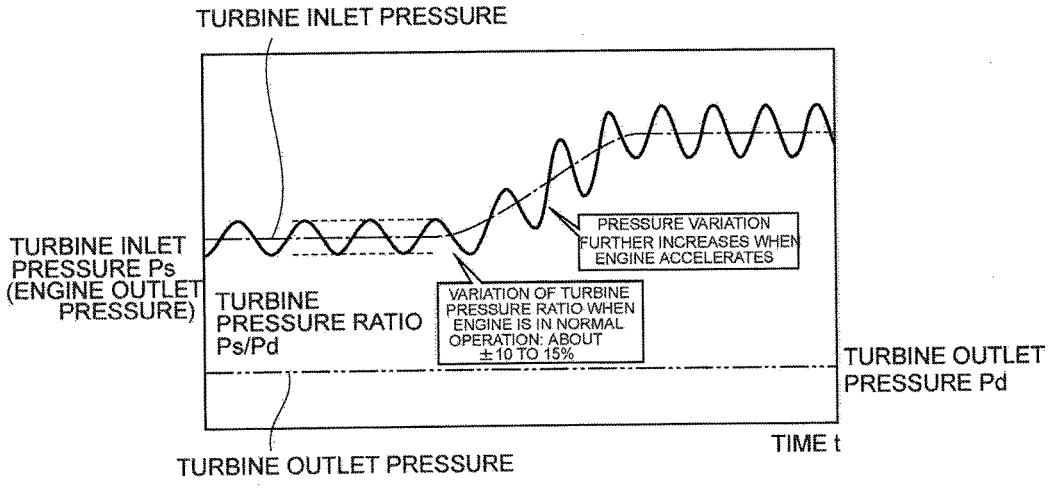
FIG. 13 is a diagram illustrating a pressure fluctuation characteristic at the turbine inlet regarding the seventh embodiment.

As shown in FIG. 13, the turbine inlet pressure Ps when the engine is equipped with a turbocharger varies depending on the number of cylinders of the reciprocating engine or the degree of acceleration, and there is pressure oscillation even during normal operation, generating a pressure oscillation of ±10 to 15%.

When this pressure oscillation occurs, a change in the absolute flow velocity that is equivalent to the change in the pressure oscillation occurs in a hub-side portion having an impulse turbine characteristic, and as a result, the inflow angle β of the relative flow coming into the rotor blade varies by about 30° to 40°.

Thus, the blade front edge wedge angle θ is set to be the angle corresponding to the variation in the inflow angle of the relative flow velocity between when the turbine inlet pressure Ps increases and when it decreases.

As shown in FIG. 14, the blade angle Ω, which is the angle formed between the suction surface Z2 of the front edge of the main blade 37 and the front edge of the intermediate blade 39 and the circumferential direction, is set to be generally equal to the inflow angle β when the turbine inlet pressure Ps increases or smaller than the inflow angle β.

By setting blade front edge wedge angle θ to the angle corresponding to the variation in the inflow angle of the relative flow velocity and by setting the blade angle ω of the suction surface Z2 to be substantially equal to or smaller than the inflow angle (β) when the pressure is at the high-pressure side, it is possible to prevent the delamination at the suction surface Z2, and to reduce the loss of flow in the impulse blade portion following a pressure oscillation.

Therefore, it is possible to prevent an increase in loss following a variation of the inflow direction due to a variation of the turbine inlet pressure in the impulse blade portion.

Eighth Embodiment

Next, referring to FIG. 15, an eighth embodiment will be described.

In the eighth embodiment, the front edge of the main blade 37 of the second embodiment of FIG. 3 is curved in the direction of rotation so as to be shaped to protrude in the opposite direction to the direction of rotation, in a cross section of the main blade 37 taken along line I-I perpendicular to the rotating shaft.

Figure 15:
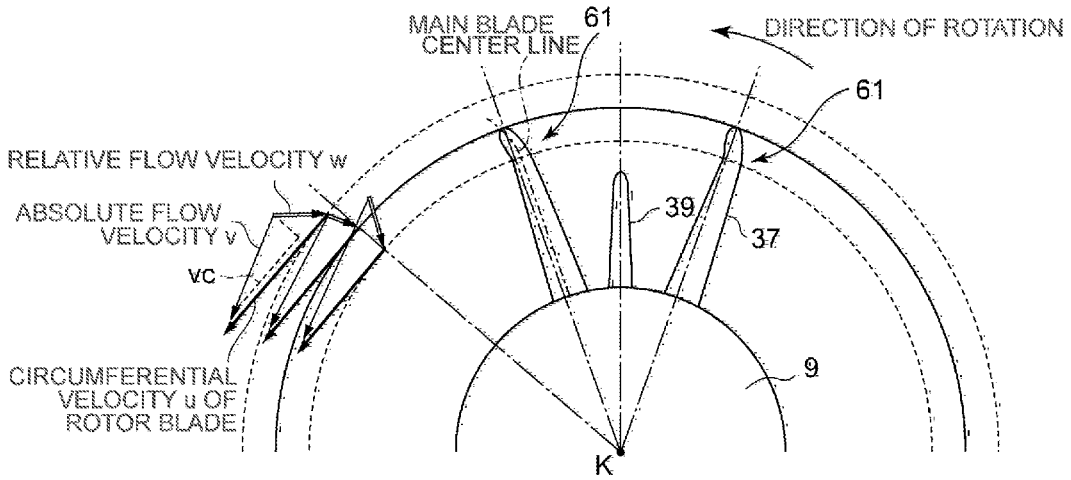
FIG. 15 is a diagram illustrating the shape of a main blade front edge portion and velocity triangles according to an eighth embodiment.

As shown in FIG. 15, the circumferential velocity U decreases corresponding to the radius of rotation, and the swirl velocity Vc, which is the circumferential direction component of the absolute flow velocity V, increases as the radius decreases because it flows radially inward while satisfying the relationship of a free vortex; as a result, the flow is implemented at the relative flow velocity W so as to hit the blade from the direction of rotation near the blade front edge of the main blade (see FIG. 15). Once the fluid goes inside of the blade front edge, the relative flow velocity W moves toward the blade while changing its direction toward the direction of rotation, thereby increasing the blade load.

Thus, if the center line of the blade front edge is curved in the direction of rotation to form a curved portion 61 shaped to protrude in the opposite direction to the direction of rotation, once it goes inside of the blade front edge, the flow moving toward the blade while the relative flow velocity W changes its direction toward the direction of rotation does not flow in to hit the blade but flows along the blade; therefore, it is possible to reduce the collision loss at the blade front edge and reduce the blade load, and it is possible to prevent an increase in the loss due to an increase in the load on the blade front edge.

With respect to a case, as a reference, where the sum of the blade area of the main blades 37 and the blade area of the intermediate blades 39 is generally equal to the blade area of a conventional technique where there are only main blades 37, the blade area load can be made generally equal by reducing the number of main blades 37 for the increase of the intermediate blades 39; similarly, if the number of main blades 37 is reduced as compared with a conventional technique, it is possible to reduce the moment of inertia as the number of main blades having a large radius is reduced.

On the other hand, however, the decrease in the number of main blades 37 increases the load on the blade front edge of the main blade 37 from the flow coming in from the shroud side, thereby increasing the loss at the blade front edge; in the present embodiment, however, it is possible to prevent an increase in the loss due to an increase in the load of the blade front edge as described above.

Therefore, if the shape is such that the blade height of the rear edge of the intermediate blade 47 of the second embodiment is higher than the front edge, it is possible to reduce the collision loss at the blade front edge occurring due to a decrease in the number of main blades during normal operation in which the shroud-side flow increases. As a result, during normal operation and also during acceleration, it is possible to realize both a reduction in the moment of inertia and an increase in the efficiency, and to further increase the efficiency as compare with the second embodiment.

Ninth Embodiment

Next, referring to FIG. 16A and FIG. 16B, a ninth embodiment will be described.

In the ninth embodiment, a blade-shaped nozzle 63 and a guide plate 65 are provided in the hub-side inflow passageway 29. Otherwise, the configuration is similar to the first embodiment.

Figure 16A:
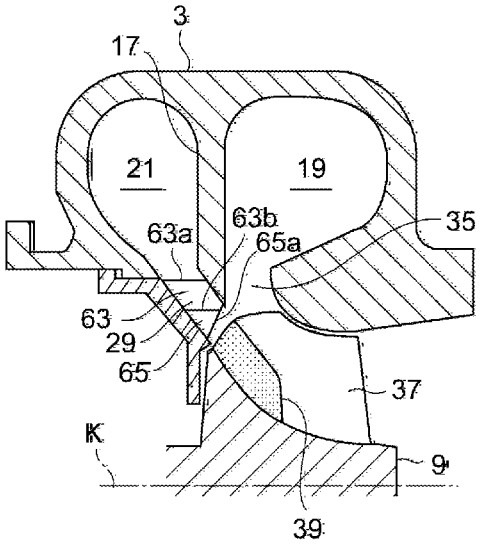
FIG. 16A is a cross-sectional view of an important part of a mixed flow turbine showing a ninth embodiment.
Figure 16B:
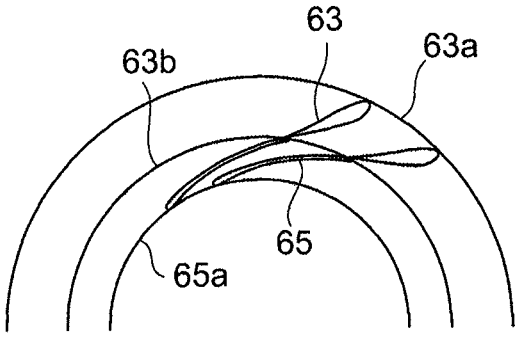
FIG. 16B is a diagram illustrating a blade-shaped nozzle and a guide plate of the ninth embodiment.

As shown in FIG. 16A and FIG. 16B, the blade-shaped nozzle 63 including a plurality of blades whose blade surface is formed to be substantially parallel to the central axis K is provided in the hub-side inflow passageway 29. The blades of the blade-shaped nozzle 63 are attached with an inclination so as to have a predetermined angle with respect to the circumference as shown in FIG. 16B. A nozzle inlet 63*a* and a nozzle outlet 63*b* of the blade-shaped nozzle 63 are each located at a fixed circumference.

Moreover, the guide plate 65 is attached corresponding to each blade on the downstream side of the blade-shaped nozzle 63. The guide plate 65 has a logarithmic spiral cross section, and is attached so as to be generally an extension of the blade-shaped nozzle 63. A downstream end 65*a* of the guide plate 65 extends close to the front edge of the main blade 37 and the intermediate blade 39.

Since the blade-shaped nozzle 63 is provided in the hub-side inflow passageway 29, it is possible to increase the circumferential velocity of the flow through the hub-side inflow passageway 29. Moreover, the flow coming out of the blade-shaped nozzle 63 flows in accordance with the law of conservation of angular momentum, and is guided by the guide plate 65 to the vicinity of the front edge of the rotor blade. Since the guide plate 65 has a logarithmic spiral cross section, it can flow into the rotor blade 11 as an ideal helical flow, and it is possible to improve the efficiency of the mixed flow turbine. Particularly, since it is provided in the hub-side inflow passageway 29, the flow of the exhaust gas flowing into the front edge of the intermediate blade 39 accelerates or becomes an ideal swirl flow, and it is therefore possible to increase the velocity of the inflow to a portion of the rotor blade 11 having a so-called "impulse turbine" characteristic, thereby improving the transient response.

Note that it is understood that the sixth embodiment, the seventh embodiment, the eighth embodiment and the ninth embodiment can be applied to main blades and intermediate blades of other embodiments as well as to those described above in the respective embodiments.

INDUSTRIAL APPLICABILITY

According to the present invention, there is provided a mixed flow turbine, wherein a front edge, through which a fluid flows in, is shaped so that a middle portion thereof between a hub side and a shroud side is formed so as to protrude toward an upstream side past a line extending between the hub side and the shroud side, and a shroud-side inflow passageway and a hub-side inflow passageway are formed by a scroll partition wall; intermediate blades having an intermediate height are provided between main blades in a hub-side portion of a turbine rotor blade exerting an impulse blade turbine characteristic, thus improving the impulse blade turbine characteristic and reducing the moment of inertia for the rotor blade as a whole, thereby improving the efficiency and improving the transient response; therefore, it is useful as a technique to be applied to mixed flow turbines for use in small gas turbines, superchargers, expanders, and the like.

EXPLANATION OF REFERENCE NUMERALS

1 Mixed flow turbine
3 Turbine housing
5 Turbine wheel
7 Rotating shaft
9 Hub
11 Rotor blade (turbine rotor blade)
13 Scroll chamber (scroll portion)
15 Shroud portion
17 Scroll partition wall
19 Shroud-side space
21 Hub-side space
23 Hub-side partition wall surface
25 Shroud-side partition wall surface
29 Hub-side inflow passageway
31 Hub outer circumferential surface
35 Shroud-side inflow passageway
37 Main blade
39, 47, 49, 51, 53, 55 Intermediate blade
43 Shroud-side inlet
45 Hub-side inlet
h1 Blade height of main blade
h2 Blade height of intermediate blade
N Center line between shroud-side passageway and hub-side passageway
E, G2 Blade height of front edge of intermediate blade
F, G3 Blade height of rear edge of intermediate blade
K Central axis
P Center line of flow through shroud-side passageway
Q Center line of flow through hub-side passageway
G1 Blade height of intermediate blade

The invention claimed is:

1. A mixed flow turbine comprising:

a turbine rotor having a front edge, through which a fluid flows in, the front edge being shaped so that a middle portion thereof between a hub side and a shroud side is formed so as to protrude toward an upstream side past a line extending between the hub side and the shroud side;

a turbine housing formed to cover the turbine rotor and having a scroll portion for supplying the fluid toward the front edge of the turbine rotor;

a scroll partition wall dividing the scroll portion into a shroud-side space and a hub-side space;

a shroud-side inflow passageway formed between a shroud-side partition wall surface on an inner periphery side of the scroll partition wall and a portion opposing the shroud-side partition wall surface, the fluid flowing through the shroud-side inflow passageway in a generally radial direction to a shroud-side inlet of the turbine rotor; and a hub-side inflow passageway formed between a hub-side partition wall surface on an inner periphery side of the scroll partition wall and a portion opposing the hub-side partition wall surface, the fluid flowing through the hub-side inflow passageway in a direction generally equal to an inclination direction of a hub to a hub-side inlet of the turbine rotor, the turbine rotor comprising:

a plurality of main blades formed to stand upright in a circumferential direction on a hub outer circumferential surface, and having a height spanning an entire extent between the hub outer circumferential surface and an inner periphery surface of a shroud portion; and a plurality of intermediate blades each of which is arranged in the circumferential direction between two of the main blades so as to extend from an inlet portion to an intermediate portion with respect to the extension of the main blades, and has an intermediate height with respect to the height of the main blades, the fluid from the hub-side inflow passageway being allowed to flow in through a front edge of each of the intermediate blades, wherein the front edge of each of the plurality of intermediate blades coincides with a front edge of a corresponding one of the plurality of main blades, while a blade height of the front edge of each of the plurality of intermediate blades is set to a position substantially equal to, or higher than, a center line on a meridional plane that divides a flow along the main blade into passageway areas of a flow through a shroud-side passageway and a flow through a hub-side passageway on a basis of a ratio between the passageway width of the shroud-side inflow passageway and the passageway width of the hub-side inflow passageway, and a blade height of a rear edge of each of the plurality of intermediate blades is set to a position higher than a blade height of the front edge of the intermediate blade.

2. The mixed flow turbine according to claim 1, wherein the intermediate blade is provided at least across an area, in a meridional shape of the turbine rotor, where an extension area of a passageway width of the hub-side inflow passageway overlaps an extension area of the shroud-side inflow passageway.

3. The mixed flow turbine according to claim 1, wherein the plurality of the intermediate blades are arranged in the circumferential direction between the main blades.

4. The mixed flow turbine according to claim 1, wherein a blade tip of each of the plurality of intermediate blades is formed to have an arc-shaped cross section.

5. The mixed flow turbine according to claim 1, comprising, in the hub-side inflow passageway, a nozzle formed by a blade surface parallel to a central axis, and a guide plate arranged on a downstream side of the nozzle so that a rear edge opposes the front edge of the turbine rotor.

6. A mixed flow turbine comprising: a turbine rotor having a front edge, through which a fluid flows in, the front edge being shaped so that a middle portion thereof between a hub side and a shroud side is formed so as to protrude toward an upstream side past a line extending between the hub side and the shroud side;

a turbine housing formed to cover the turbine rotor and having a scroll portion for supplying the fluid toward the front edge of the turbine rotor;

a scroll partition wall dividing the scroll portion into a shroud-side space and a hub-side space;

a shroud-side inflow passageway formed between a shroud-side partition wall surface on an inner periphery side of the scroll partition wall and a portion opposing the shroud-side partition wall surface, the fluid flowing through the shroud-side inflow passageway in a generally radial direction to a shroud-side inlet of the turbine rotor; and a hub-side inflow passageway formed between a hub-side partition wall surface on an inner periphery side of the scroll partition wall and a portion opposing the hub-side partition wall surface, the fluid flowing through the hub-side inflow passageway in a direction generally equal to an inclination direction of a hub to a hub-side inlet of the turbine rotor, the turbine rotor comprising:

a plurality of main blades formed to stand upright in a circumferential direction on a hub outer circumferential surface, and having a height spanning an entire extent between the hub outer circumferential surface and an inner periphery surface of a shroud portion; and a plurality of intermediate blades each of which is arranged in the circumferential direction between two of the main blades so as to extend from an inlet portion to an intermediate portion with respect to the extension of the main blades, and has an intermediate height with respect to the height of the main blades, the fluid from the hub-side inflow passageway being allowed to flow in through a front edge of each of the intermediate blades, wherein a front edge of the intermediate blade is provided at a position less than a front edge radius of the main blade, and a blade height of the intermediate blade across an entire extent from upstream to downstream is maintained constantly at a position at a substantially equal height to, or higher than, a height of a center line on a meridional plane that divides a flow along the main blade into passageway areas of a flow through a shroud-side passageway and a flow through a hub-side passageway on the basis of a ratio between the passageway width of the shroud-side inflow passageway and the passageway width of the hub-side inflow passageway.

7. The mixed flow turbine according to claim 6, wherein a radius of the front edge of each of the plurality of intermediate blades is set to a radius substantially equal to a radius at which the intermediate blade is attached to the hub.

8. The mixed flow turbine according to claim 6, comprising, in the hub-side inflow passageway, a nozzle formed by a blade surface parallel to a central axis, and a guide plate arranged on a downstream side of the nozzle so that a rear edge opposes the front edge of the turbine rotor.

9. The mixed flow turbine according to claim 6, wherein a blade tip of each of the intermediate blades is formed to have an arc-shaped cross section.

10. A mixed flow turbine comprising: a turbine rotor having a front edge, through which a fluid flows in, the front edge being shaped so that a middle portion thereof between a hub side and a shroud side is formed so as to protrude toward an upstream side past a line extending between the hub side and the shroud side;

a turbine housing formed to cover the turbine rotor and having a scroll portion for supplying the fluid toward the front edge of the turbine rotor;

a scroll partition wall dividing the scroll portion into a shroud-side space and a hub-side space;

a shroud-side inflow passageway formed between a shroud-side partition wall surface on an inner periphery side of the scroll partition wall and a portion opposing the shroud-side partition wall surface, the fluid flowing through the shroud-side inflow passageway in a generally radial direction to a shroud-side inlet of the turbine rotor; and a hub-side inflow passageway formed between a hub-side partition wall surface on an inner periphery side of the scroll partition wall and a portion opposing the hub-side partition wall surface, the fluid flowing through the hub-side inflow passageway in a direction generally equal to an inclination direction of a hub to a hub-side inlet of the turbine rotor, the turbine rotor comprising:

a plurality of main blades formed to stand upright in a circumferential direction on a hub outer circumferential surface, and having a height spanning an entire extent between the hub outer circumferential surface and an inner periphery surface of a shroud portion; and a plurality of intermediate blades each of which is arranged in the circumferential direction between two of the main blades so as to extend from an inlet portion to an intermediate portion with respect to the extension of the main blades, and has an intermediate height with respect to the height of the main blades, the fluid from the hub-side inflow passageway being allowed to flow in through a front edge of each of the intermediate blades, wherein a front edge of the intermediate blade is provided at a position less than a front edge radius of the main blades, while a blade height of each of the plurality of intermediate blades across an entire extent from an upstream to downstream is set to a position higher than a center line on a meridional plane that divides a flow along the main blade into passageway areas of a flow through a shroud-side passageway and a flow through a hub-side passageway on a basis of a ratio between the passageway width of the shroud-side inflow passageway and the passageway width of the hub-side inflow passageway, and a blade height of a rear edge of each of the plurality of intermediate blades is set to a position higher than a blade height of the front edge of the intermediate blade.

11. The mixed flow turbine according to claim 10, comprising, in the hub-side inflow passageway, a nozzle formed by a blade surface parallel to a central axis, and a guide plate arranged on a downstream side of the nozzle so that a rear edge opposes the front edge of the turbine rotor.

12. The mixed flow turbine according to claim 10, wherein a blade tip of each of the intermediate blades is formed to have an arc-shaped cross section.

13. A mixed flow turbine comprising: a turbine rotor having a front edge, through which a fluid flows in, the front edge being shaped so that a middle portion thereof between a hub side and a shroud side is formed so as to protrude toward an upstream side past a line extending between the hub side and the shroud side;

a turbine housing formed to cover the turbine rotor and having a scroll portion for supplying the fluid toward the front edge of the turbine rotor;

a scroll partition wall dividing the scroll portion into a shroud-side space and a hub-side space;

a shroud-side inflow passageway formed between a shroud-side partition wall surface on an inner periphery side of the scroll partition wall and a portion opposing the shroud-side partition wall surface the fluid flowing through the shroud-side inflow passageway in a generally radial direction to a shroud-side inlet of the turbine rotor; and a hub-side inflow passageway formed between a hub-side partition wall surface on an inner periphery side of the scroll partition wall and a portion opposing the hub-side partition wall surface, the fluid flowing through the hub-side inflow passageway in a direction generally equal to an inclination direction of a hub to a hub-side inlet of the turbine rotor, the turbine rotor comprising:

a plurality of main blades formed to stand upright in a circumferential direction on a hub outer circumferential surface, and having a height spanning an entire extent between the hub outer circumferential surface and an inner periphery surface of a shroud portion; and a plurality of intermediate blades each of which is arranged in the circumferential direction between two of the main blades so as to extend from an inlet portion to an intermediate portion with respect to the extension of the main blades, and has an intermediate height with respect to the height of the main blades, the fluid from the hub-side inflow passageway being allowed to flow in through a front edge of each of the intermediate blades, wherein the front edge of each of the plurality of intermediate blades coincides with a front edge of corresponding one of the main blades, and a blade height of each of the plurality of intermediate blades gradually decreases toward a rear edge of the intermediate blade.

14. The mixed flow turbine according to claim 13, comprising, in the hub-side inflow passageway, a nozzle formed by a blade surface parallel to a central axis, and a guide plate arranged on a downstream side of the nozzle so that a rear edge opposes the front edge of the turbine rotor.

15. The mixed flow turbine according to claim 13, wherein a blade tip of each of the intermediate blades is formed to have an arc-shaped cross section.

16. A mixed flow turbine comprising:

a turbine rotor having a front edge, through which a fluid flows in, the front edge being shaped so that a middle portion thereof between a hub side and a shroud side is formed so as to protrude toward an upstream side past a line extending between the hub side and the shroud side;

a turbine housing formed to cover the turbine rotor and having a scroll portion for supplying the fluid toward the front edge of the turbine rotor;

a scroll partition wall dividing the scroll portion into a shroud-side space and a hub-side space;

a shroud-side inflow passageway formed between a shroud-side partition wall surface on an inner periphery side of the scroll partition wall and a portion opposing the shroud-side partition wall surface, the fluid flowing through the shroud-side inflow passageway in a generally radial direction to a shroud-side inlet of the turbine rotor; and a hub-side inflow passageway formed between a hub-side partition wall surface on an inner periphery side of the scroll partition wall and a portion opposing the hub-side partition wall surface, the fluid flowing through the hub-side inflow passageway in a direction generally equal to an inclination direction of a hub to a hub-side inlet of the turbine rotor, the turbine rotor comprising:

a plurality of main blades formed to stand upright in a circumferential direction on a hub outer circumferential surface, and having a height spanning an entire extent between the hub outer circumferential surface and an inner periphery surface of a shroud portion; and a plurality of intermediate blades each of which is arranged in the circumferential direction between two of the main blades so as to extend from an inlet portion to an intermediate portion with respect to the extension of the main blades, and has an intermediate height with respect to the height of the main blades, the fluid from the hub-side inflow passageway being allowed to flow in through a front edge each of the intermediate blades, wherein the front edge of each of the plurality of main blades and each of the intermediate blades includes a pressure surface and a suction surface, a blade front edge wedge angle is formed between the pressure surface and the suction surface of the front edge of each of the plurality of main blades and each of the intermediate blades, and the blade front edge wedge angle ($\theta$) is set so an angle corresponding to a change in an inflow angle ($\beta$) of the fluid, following a pressure variation of the fluid, to the front edge of corresponding one of the plurality of main blades or the intermediate blades, and a blade angle ($\omega$) which is an angle formed between the suction surface (Z2) of the front edge of each of the plurality of main blades and each of the intermediate blades and the circumferential direction, is set to be substantially equal to or less than an inflow angle to the blade front edge when the pressure variation increases toward a high-pressure side.

17. A mixed flow turbine comprising: a turbine rotor having a front edge, through which a fluid flows in, the front edge being shaped so that a middle portion thereof between a hub side and a shroud side is formed so as to protrude toward an upstream side past a line extending between the hub side and the shroud side;

a turbine housing formed to cover the turbine rotor and having a scroll portion for supplying the fluid toward the front edge of the turbine rotor;

a scroll partition wall dividing the scroll portion into a shroud-side space and a hub-side space;

a shroud-side inflow passageway formed between a shroud-side partition wall surface on an inner periphery side of the scroll partition wall and a portion opposing the shroud-side partition wall surface, the fluid flowing through the shroud-side inflow passageway in a generally radial direction to a shroud-side inlet of the turbine rotor; and a hub-side inflow passageway formed between a hub-side partition wall surface on an inner periphery side of the scroll partition wall and a portion opposing the hub-side partition wall surface, the fluid flowing through the hub-side inflow passageway in a direction generally equal to an inclination direction of a hub to a hub-side inlet of the turbine rotor, the turbine rotor comprising:

a plurality of main blades formed to stand upright in a circumferential direction on a hub outer circumferential surface, and having a height spanning an entire extent between the hub outer circumferential surface and an inner periphery surface of a shroud portion; and plurality of intermediate blades each of which is arranged in the circumferential direction between two of the main blades so as to extend from an inlet portion to an intermediate portion with respect to the extension of the main blades, and has an intermediate height with respect to the height of the main blades, the fluid from the hub-side inflow passageway being allowed to flow in through a front edge of each of the intermediate blades, wherein the cross-sectional profile of a front edge portion of the main blade in a normal cross section to a rotating shaft is formed by curving the front edge portion of the main blade in a direction of rotation to have a shape which is protruded in an opposite direction to the direction of rotation.

* * * * *